US005407894A

United States Patent [19]

Hayashi et al.

[11] Patent Number: 5,407,894

[45] Date of Patent: Apr. 18, 1995

[54] THERMAL-TRANSFER DYE-IMAGE-RECEIVING SHEET

[75] Inventors: Shigeo Hayashi, Kawasaki; Koji Narita, Ichikawa; Yukio Kusaka, Utsunomiya, all of Japan

[73] Assignee: New Oji Paper Co., Ltd., Tokyo, Japan

[21] Appl. No.: 243,829

[22] Filed: May 17, 1994

[30] Foreign Application Priority Data

May 20, 1993 [JP] Japan ..... 5-139928

[51] Int. Cl.[6] ..... B41M 5/035; B41M 5/38

[52] U.S. Cl. ..... 503/227; 428/195; 428/341; 428/342; 428/412; 428/413; 428/476.9; 428/480; 428/483; 428/500; 428/513; 428/913; 428/914

[58] Field of Search ..... 8/471; 428/195, 341, 428/342, 412, 413, 474.4, 476.9, 480, 483, 500, 913, 914

[56] References Cited

U.S. PATENT DOCUMENTS 4,774,224 9/1988 Campbell ..... 503/227
4,778,782 10/1988 Ito et al. ..... 503/227
4,999,335 3/1991 Mruk et al. ..... 503/227

FOREIGN PATENT DOCUMENTS 2-307786 5/1989 Japan .
2-106397 4/1990 Japan .

OTHER PUBLICATIONS

Japanese Industrial Standard; Testing Method for Flexural Properties of Rigid Plastics; JIS K 7203; 1982; translated and published by Japanese Standards Association.

Database WPILn 90-199038, Derwent Publications Ltd., London, GB; & JP-A-2133699 (OJI Paper) May 22, 1990 (The entire abstract).

Database WPILn 91-039570, Derwent Publications Ltd., London, GB; & JP-A-2305688 (Mitsubishi Paper) Dec. 19, 1990 (The entire abstract).

*Primary Examiner*—B. Hamilton Hess
*Attorney, Agent, or Firm*—Armstrong, Westerman, Hattori, McLeland & Naughton

[57] ABSTRACT

A thermal transfer dye-image-receiving sheet useful for producing clear dye images having a high evenness in color density, includes a resin coating layer formed on at least one surface of a substrate paper sheet, comprising a thermoplastic resin, for example, polyolefin, and having a modulus of elasticity in flexure of less than 7,000 kg/cm$^2$ as determined in accordance with Japanese Industrial Standard K 7203, and a dye-image-receiving layer formed on the resin-coating layer and comprising a dye-receiving resin.

5 Claims, No Drawings

THERMAL-TRANSFER DYE-IMAGE-RECEIVING SHEET

BACKGROUND OF THE INVENTION

1. Field of the Invention

The present invention relates to a thermal-transfer dye-image-receiving sheet. More particularly, the present invention relates to a thermal-transfer dye-image-receiving sheet capable of producing clear images having a very even color density when used in a dye-image-thermal-transfer printer.

2. Description of the Related Art

Currently, development of a thermal image-transfer printer capable of producing high quality colored images, especially a dye-thermal-transfer printer is progressing rapidly. In the dye-thermal-transfer printer, colored images or pictures are formed by superposing thermally transferred yellow, magenta and cyan colored images or pictures in the form of a number of dots, to produce continuous tone full-color images or pictures having a continuous hue and color density. In a dye-image-thermal-transfer printing operation, an ink sheet composed of a base film and a sublimating yellow, magenta or cyan dye layer formed on the base film is superposed on a dye-image-receiving sheet composed of a substrate sheet and a dye-image-receiving layer formed on the substrate sheet in such a manner that the sublimating dye layer of the ink sheet comes into contact with the dye-image-receiving layer of the dye-image-receiving sheet, and the ink sheet is locally heated by a heat supplied by a thermal head in the printer. The amount of the heat is continuously controlled in accordance with electric signals corresponding to the images or pictures to be printed, and portions of the sublimating dye ink in the dye layer are thermally transferred to the dye-image-receiving layer to provide colored images in a predetermined pattern and having a predetermined color density. It is known that to print high quality colored images on a dye-image-receiving sheet at a high speed using a dye-thermal-transfer printer, a biaxially oriented multilayer film comprising, as a principal component, a thermoplastic resin, for example, polyolefin resins, and having a plurality of voids formed therein, is used as a substrate sheet for the thermal-transfer dye-image-receiving sheet. A conventional thermal-transfer dye-image-receiving sheet, which will be referred to as a dye-image-receiving sheet hereinafter, has a dye-image-receiving layer formed on the above-mentioned substrate sheet and comprises, as a principal component, a dye-receiving thermoplastic resin. Where a biaxially oriented multilayer thermoplastic resin film is used as a substrate sheet, the resultant dye-image-receiving sheet is advantageous in being very even in thickness, in a satisfactory flexibility and softness and in a low thermal conductivity thereof, compared with other dye-image-receiving sheets in which the substrate sheet consists of a conventional paper sheet made from cellulose pulp fibers, and thus the colored images printed on the dye-image-receiving sheet have a high color density and a satisfactory evenness in color density.

Nevertheless, where the biaxially oriented multilayer thermoplastic film is used as a substrate sheet for a dye-image-receiving sheet which is strictly required to exhibit a high reproducability of the colored images, the resultant dye-image-receiving sheet is disadvantageous in that, when the dye images are recorded on the sheet using a thermal head, the remaining stress in the substrate sheet derived from a drawing process applied to the thermoplastic resin film is released, and thus a difference in thermal shrinkage is generated between the substrate sheet and the dye-image-receiving layer to cause the dye-image-receiving sheet to be locally curled and wrinkled. These curls and wrinkles hinder the smooth conveyance of the dye-image-receiving sheet through the printer, and the resultant print has a significantly poor commercial value. Even when the biaxially oriented multilayer film has a front surface layer and a back surface layer equal in thermal shrinking property to each other, since the heat is applied only to the front surface of the dye-image-receiving sheet during the printing operation, the temperature of the front surface is different from that of the back surface, and thus the dye-image-receiving sheet is curled or wrinkled.

Also, the lamination of the biaxially oriented films to form the front and back surface layers causes the resultant multilayer film to be expensive.

To eliminate the above-mentioned disadvantages, for example, the unevenness in color density of the images, by not employing the thermoplastic biaxially oriented multilayer film as a substrate sheet, Japanese Unexamined Patent Publications (Kokai) No. 2-106,397 and No. 2-307,786 disclose a substrate sheet comprising a base sheet consisting of a paper sheet and having a high surface smoothness and a polyolefin coating layer laminated on a base sheet surface and having a thickness of 5 to 35 μm and a basis weight of 5 to 25 g/m$^2$. In this type of substrate sheet, the quality of the dye image can be improved to a certain extent by controlling the amount of the polyolefin coating layer. However, this type of substrate sheet does not fully eliminate the unevenness in the color density of the received dye images.

U.S. Pat. No. 4,774,224 to Eastman Kodak Co. discloses that to reduce the unevenness in color density and the glossiness of the dye images, the center line surface roughness of a surface of a substrate comprising a substrate paper sheet and an organic polymer layer laminated on the substrate sheet is controlled to a level of 7.5 microinches ($7.5\times25.4\times10^{-3}=0.1905$ μm). However, the effect of the laminated substrate in enhancing the evenness in the color density and glossiness of the received dye images is still not satisfactory.

SUMMARY OF THE INVENTION

An object of the present invention is to provide a thermal-transfer dye-image-receiving sheet comprising a thermoplastic resin coating layer formed on a substrate paper sheet and capable of recording thereon thermally-transferred dye-images with an enhanced evenness in color density.

The above-mentioned object can be attained by the thermal transfer dye-image-receiving sheet of the present invention, which comprises a substrate sheet comprising cellulose pulp; a resin coating layer formed on at least one surface of the substrate sheet and comprising a thermoplastic resin; and a dye-image-receiving layer formed on the resin-coating layer and comprising a resin capable of receiving a thermally transferable dye for forming dye images, the resin-coating layer having a modulus of elasticity in flexure less than 7,000 kg/cm$^2$ as determined in accordance with Japanese Industrial Standard K 7203.

DESCRIPTION OF THE PREFERRED EMBODIMENTS

It is known that when a conventional substrate sheet comprising a base paper sheet and a polyolefin coating layer laminated on the base paper sheet is used, and the resultant dye-image-receiving sheet is subjected to a thermal transfer printing procedure, sometimes the dye images recorded on the dye-image-receiving sheet are uneven in color density thereof and sometimes white portions are formed in the recorded images due to non-transfer of the dye. It is thought that these disadvantages are caused by a rough surface on the polyolefin coating layer and/or the base paper sheet.

In the present invention, these disadvantages are effectively eliminated by forming a specific resin-coating layer between the substrate sheet and the dye-image-receiving layer. Namely, the dye-image-receiving sheet of the present invention can record thereon clear dye images having a satisfactory color density and an excellent evenness in the color density. The reasons why the recorded images have a high quality as mentioned above are not fully clear. However, the reasons are assumed to be as follows.

During a printing operation, a dye-image-receiving sheet superposed on a dye ink sheet is interposed and pressed between a thermal head and a platen roller and a dye is thermally transferred imagewise from the dye ink sheet to the dye-image-receiving sheet under pressure. When the surface of the dye-image-receiving sheet is smooth, the smooth surface of the dye-image-receiving sheet uniformly comes into close contact with the thermal head and the dye is thermally transferred imagewise with a high evenness in color density to provide clear and uniform dye images. However, if the surface of the dye image receiving sheet has a plurality of convexities and concavities, which may be small, and the dye-image-receiving sheet has a high elastic modulus in flexure, the convexities do not deform even when a thermal head comes into contact with and presses the convexities. Therefore, the thermal head cannot come into close contact with the concavities on the surface of the dye-image-receiving sheet. This phenomenon results in an unevenness in color density of the recorded dye images.

However, even if the surface of the dye-image-receiving sheet is slightly rough, if the resin coating layer of the dye-image-receiving sheet has a low modulus of elasticity (Young's modulus) in flexure less than 7,000 kg/cm$^2$, preferably 600 to 6,000 kg/cm$^2$, the convexities can be easily smoothed so that the thermal head can come into close contact with the entire surface of the dye-image-receiving sheet, and thus the dye images are uniformly transferred onto the dye-image-receiving sheet surface with a high evenness in color density.

The thermoplastic resins usable for the resin-coating layer of the dye-image-receiving sheet include polyethylene resins, for example, low density polyethylene resins and high density polyethylene resins, $\alpha$-olefin homopolymer resins, for example, polypropylene resins, polybutene resins, and polypentene resins; copolymer resins of two or more of ethylene and $\alpha$-olefins having 3 to 50 carbon atoms, preferably 3 to 6 carbon atoms, for example, ethylene-propylene copolymer resins; and mixtures of two or more of the above-mentioned homopolymer and copolymer resins.

The modulus of elasticity in flexure of the resin-coating layer can be controlled to a level of 7,000 kg/cm$^2$ or less by blending two or more brands of a thermoplastic resin different in molecular weight from each other, with each other, blending two or more types of thermoplastic resins, for example, a polypropylene resin and a polyethylene resin, with each other, or varying the coating temperature of the resin coating layer preferably in the range of 300° C. or more.

The thermoplastic resins usable for the resin coating layer optionally contain an additive comprising at least one member selected from the group consisting of amides and metal salts of higher fatty acids, for example, stearic acid amide, and zinc stearate; antioxidants, for example, antioxidative phosphorus compounds; and pigments and dyes, for example, titanium dioxide, cobalt blue, and ultramarine blue. The additive is used for the purpose of adjusting the modulus of elasticity in flexure of the resin-coating layer to a level of 7,000 kg/cm$^2$ or less.

In the present invention, the resin-coating layer is formed on a surface of a substrate sheet by a melt-extrude-laminating method. It is preferable that the melt-extrude-laminating procedure be carried out so that the resultant resin-coating layer exhibits a high evenness in surface smoothness and a satisfactory bonding strength to the substrate sheet.

The resin-coating layer preferably has a weight of 10 to 40 g/m$^2$. If the resin-coating layer is in an amount less than 10 g/m$^2$, the color-density evenness-enhancing effect thereof sometimes becomes unsatisfactory. Also, the resin-coating layer in an amount of more than 40 g/m$^2$ sometimes causes the color density of the recorded dye image to be unsatisfactory.

The substrate sheet usable for the present invention comprises cellulose fibers. The cellulose fibers are not restricted to a specific type of fibers. For example, the cellulose fibers include wood pulp, for example, chemical pulp and mechanical pulp of hard woods and soft woods, waste paper pulp; non-wood natural cellulose pulp, for example, flax pulp and cotton pulp; and regenerated cellulose fibers, for example, viscose rayon fibers. The substrate sheet optionally contains a small amount of at least one member selected from synthetic polymer pulps, for example, polyethylene pulps and polypropylene pulps, synthetic organic fibers, for example, polyacrylic fibers, phenol resin fibers, polyamide fibers and polyester fibers, and inorganic fibers, for example, glass fibers, carbon fibers and alumina fibers.

The content of the fibers other than the cellulose fibers in the substrate sheet is preferably 20% by weight or less, more preferably 10% by weight or less. Preferably, the substrate sheet comprises a hard wood chemical pulp.

The substrate sheet optionally further contains an additive selected from anionic, cationic, nonionic and ampholytic yield-improving agents, paper tenacity-enhancing agents and sizing agents. Preferably, the substrate sheet consists of a paper sheet comprising 50% by weight or more of cellulose pulp.

The dye-image-receiving layer of the present invention is formed from a resin capable of receiving and fixing a dye thermally transferred from a dye ink sheet. The dye-receivable resin is preferably selected from thermoplastic saturated polyester resins, vinyl chloride-containing resins, for example, vinyl chloride-vinyl acetate copolymer resins and vinyl chloride-vinyl propionate copolymer resins, poly-carbonate resins, polyvinyl acetal resins, polyamide resins and epoxy resins. More preferably, the dye-receivable resin is selected from the thermoplastic saturated polyester resins and the vinyl chloride copolymer resins.

The dye-image-receiving layer optionally contains at least one organic compound having a low molecular weight, for example, a substituted phenol compound or a terpene compound, which are employed for the purpose of antioxidation, ultraviolet ray-absorption or sensitizing. Also, if necessary, the dye-image-receiving layer contains a white pigment, for example, titanium dioxide or calcium carbonate, which effectively enhances the whiteness and opacity of the dye-image-receiving layer; a fluorescent brightening dye for brightening the hue of the dye-image-receiving layer; and a dye, for example, a blue dye or a violet dye, which is used to control the hue of the dye-image-receiving layer.

The white pigments or the ultraviolet ray absorbing agents are advantageously employed by mixing them with the dye-receiving resin and coating the mixture on the substrate sheet surface. However, they may be contained in another layer arranged on or under the dye-image-receiving layer.

To prevent a fuse-adhesion of the dye ink sheet with the dye-image-receiving layer during the thermal transfer printing operation, a release agent may be contained in the dye-image-receiving layer. The release agent comprises at least one member of, for example, waxes, for example, paraffin and polyethylene waxes; metallic soaps, for example, zinc stearate; silicone compounds, for example, silicone oils and silicone resins; and fluorine compounds, for example, fluorine-containing surfactants and fluorine-containing resins. The release agent is preferably used in a content of 15% by weight or less for the dye-image-receiving layer.

Optionally, an intermediate layer is arranged between the resin coating layer and the dye-image-receiving layer to improve the bonding strength therebetween.

The intermediate layer can be formed from a hydrophilic resin or a hydrohobic resin, for example, vinyl polymers, for example, polyvinyl alcohol and polyvinyl pyrrolidone, derivatives of the vinyl polymers, polyacrylamides, polydimethylacrylamides polyacrylic acid, polyacrylic acid salts, polyacrylic acid esters, polymethacrylic acid, polymethacrylic acid esters, starch, sodium alginate, polyethyleneimine and carboxymethylcellulose.

To prevent a static electrification of the dye-image-receiving sheet during the printing operation and to avoid a blockage of the printer by the dye-image-receiving sheet, an antistatic agent may be coated at least one surface of the dye-image-receiving sheet or contained in the dye-image-receiving layer. The antistatic agent is preferably selected from hydrophilic cationic polymeric compounds.

EXAMPLES

The present invention will be further illustrated by the following specific examples which are merely representative and do not in any way restrict the scope of the present invention.

In the examples, the elastic modulus in flexure of the resin-coating layer was determined in accordance with Japanese Industrial Standard K 7203, in the following manner.

A resin coating layer having a thickness of about 4 mm was formed on a substrate sheet by a melt-extrude-laminating method and then separated from the substrate sheet by a peeling operation. The separated resin sheet was immersed in a concentrated sodium hydroxide solution at room temperature for 72 hours. Then the resin sheet was removed from the sodium hydroxide solution and rinsed with water to remove residual cellulose fibers. The resultant resin sheet was subjected to a measurement of the modulus of elasticity in flexure.

Example 1

A substrate sheet was provided from a fine paper sheet having a basis weight of 76 g/m$^2$.

The front and back surfaces of the substrate sheet were coated with a polyethylene resin consisting of a polyethylene having a specific gravity of 0.92 g/cm$^2$, by a melt-extrude-laminating method at the temperature as indicated in Table 1. The resultant resin-coating layers were in an amount of 20 g/m$^2$ per surface of the substrate sheet and had the modulus of elasticity in flexure indicated in Table 1.

The front resin-coating layer was subjected to a corona discharge treatment and then coated with a coating liquid, having the following composition, using a wire bar, and then dried.

Composition of coating liquid for dye image-receiving layer

| Component | Part by weight |
|---|---|
| Saturated polyester resin(*)1 | 100 |
| Silicone oil(*)2 | 3 |
| Isocyanate compound(*)3 | 5 |
| Toluene | 300 |

Note:
(*)1Trademark: Vilon 200, made by Toyobo K.K.
(*)2Trademark: KF 393, made by Shinetsu Silicone K.K.
(*)3Trademark: Takenate D-110N made by Takeda Yakuhin K.K.

The resultant dried dye image-receiving layer had a weight of 6 g/m$^2$.

The resultant dye image-receiving sheet was subjected to a dye thermal transfer printing procedure by using a printer (trademark: AG-EP60, made by Matsushita Denki K.K.)

In the printing procedure, dye images were printed on the dye image-receiving layer in accordance with step pattern signals output from a color bar signal generator (trademark: C13A2, made by Shibazoku K.K.).

The evenness in color density of the printed dye images was measured by a dot analyzer. In the measurement, the number of white dots having an area of 2,000 $\mu$m$^2$ per cm$^2$ of the printed dye images was counted. When one or more white dots having an area of 2,000 $\mu$m$^2$ or more per cm$^2$ were detected, the evenness in color density of the dye images was evaluated bad.

The test results are shown in Table 2.

Examples 2 to 4 and Comparative Examples 1 to 3

In each of Examples 2 to 4 and Comparative Examples 1 to 3, a thermal transfer dye image-receiving sheet was produced and tested by the same procedures as in Example 1 with the following exceptions.

The resin-coating layer was formed at the coating temperature indicated in Table 1.

In the formation of the resin-coating layer, the polyethylene resin was replaced by the following resins.

In Example 2, the polypropylene resin as indicated in Table 1 was employed.

In Example 3, the polypropylene resin as indicated in Table 1 was used.

In Example 4, the polyethylene resin as indicated in Table 1 was used.

In Example 5, the polypropylene resin as indicated in Table 1 was employed.

In Example 6, the blend of 50% by weight of the polyethylene with 50% by weight of the polypropylene as indicated in Table 1 was employed.

In Comparative Example 1, the polyethylene resin as indicated in Table 1 was used.

In Comparative Example 2, the polypropylene resin as indicated in Table 1 was used.

In Comparative Example 3, the polypropylene resin as indicated in Table 1 was employed. The test results are shown in Table 2.

TABLE 1

| | Item | | | | | |
|---|---|---|---|---|---|---|
| | Resin coating layer | | | | Modulus of elasticity in flexure of resin-coating layer | Coating temperature |
| Example No. | Type of resin | Brand(*)3 (Trademark) | Density (g/cm²) | MFR | (kg/cm²) | (°C.) |
| Example | | | | | | |
| 1 | PE(*)1 | LK 50 | 0.92 | 4.6 | 2,700 | 320 |
| 2 | PP(*)2 | FL 25K | 0.89 | 21 | 5,700 | 300 |
| 3 | PP | FX 4 | 0.89 | 6 | 6,500 | 300 |
| 4 | PE | X 707-6 | 0.94 | 10 | 6,500 | 320 |
| 5 | PP | FL 6S | 0.90 | 23 | 6,800 | 320 |
| 6 | PE/PP (50/50) | LY 20/ FL 25K | 0.92 | 15 | 6,300 | 320 |
| Comparative Example | | | | | | |
| 1 | PE | LY 20 | 0.94 | 8 | 7,000 | 320 |
| 2 | PP | FL 6S | 0.90 | 2.3 | 11,900 | 280 |
| 3 | PP | FL 25B | 0.90 | 30 | 10,000 | 280 |

Note:
(*)1PE . . . Polyethylene
(*)2PP . . . Polypropylene
(*)3Made by Mitsubishi Yuka K. K.

TABLE 2

| Example No. | Item Evenness in color density of printed dye images (white dots/cm²) |
|---|---|
| Example | |
| 1 | 0 |
| 2 | 0 |
| 3 | 0 |
| 4 | 0 |
| 5 | 0 |
| 6 | 0 |
| Comparative Example | |
| 1 | 266 |
| 2 | 833 |
| 3 | 566 |

Table 1 clearly indicates that the resin-coating layer formed between the substrate sheet and the dye image-receiving layer and having modulus of elasticity in flexure of less than 7,000 kg/cm² significantly contributed to providing clear dye images on the dye-image-receiving layer and to enhancing the evenness in the color density of the dye images.

We claim:

1. A thermal transfer dye-image-receiving sheet comprising:

a substrate sheet comprising cellulose fibers;

a resin-coating layer formed on at least one surface of the substrate sheet and comprising a thermoplastic resin; and a dye-image-receiving layer formed on the resin-coating layer and comprising a resin capable of receiving a thermally transferable dye for forming dye images, the resin-coating layer having a modulus of elasticity in flexure less than 7,000 kg/cm² as determined in accordance with Japanese Industrial Standard K 7203.

2. The thermal transfer dye-image-receiving sheet as claimed in claim 1, wherein the thermoplastic resin for the resin coating layer comprises at least one member selected from the group consisting of polyethylene, polypropylene, polybutene, polypentene and copolymers of at least one member selected from the group consisting of ethylene and $\alpha$-olefins having 3 to 50 carbon atoms.

3. The thermal transfer dye-image-receiving sheet as claimed in claim 1 wherein the resin-coating layer has a basic weight of 10 to 40 g/m².

4. The thermal transfer dye-image-receiving sheet as claimed in claim 1, wherein the dye-receiving resin for the dye-image-receiving layer comprises at least one member selected from the group consisting of thermoplastic saturated polyester resins, vinyl-chloride copolymer resins, polycarbonate resins, polyvinyl acetal resins, polyamide resins and epoxy resins.

5. The thermal transfer dye-image-receiving sheet as claimed in claim 1, further comprising an intermediate layer arranged between the resin-coating layer and the dye-image-receiving layer and comprising at least one member selected from polyvinyl alcohol resins, polyvinyl pyrrolidone resins, polyacrylamide resins, polydimethylacrylamide resins, polyacrylic acid resins, polyacrylic acid salt resins, polyacrylic acid ester resins, polymethacrylic acid resins, polyacrylic acid ester resins, starch, sodium alginate, polyethyleneimine resins and carboxymethyl cellulose.

* * * * *